US007841092B2

(12) United States Patent
Dern

(10) Patent No.: US 7,841,092 B2
(45) Date of Patent: Nov. 30, 2010

(54) HAND-HELD CIRCULAR SAW WITH ALIGNMENT FEATURES FOR PERPENDICULAR CUTS

(76) Inventor: Klaus Dern, 240 Peaceful Path, Ellijay, GA (US) 30536

( * ) Notice: Subject to any disclaimer, the term of this patent is extended or adjusted under 35 U.S.C. 154(b) by 296 days.

(21) Appl. No.: 12/080,854

(22) Filed: Apr. 7, 2008

(65) Prior Publication Data

US 2008/0264229 A1 Oct. 30, 2008

Related U.S. Application Data

(60) Provisional application No. 60/926,551, filed on Apr. 27, 2007.

(51) Int. Cl.
*B27B 9/04* (2006.01)

(52) U.S. Cl. ..... 30/371; 30/388

(58) Field of Classification Search ..... 30/371, 30/378, 388, 372, 375, 376, 390
See application file for complete search history.

(56) References Cited

U.S. PATENT DOCUMENTS

| | | | | |
|---|---|---|---|---|
| 4,730,396 | A * | 3/1988 | Nishioka | 30/371 |
| 4,777,726 | A * | 10/1988 | Flowers | 30/374 |
| 5,561,907 | A * | 10/1996 | Campbell et al. | 30/371 |
| 2005/0278960 | A1 * | 12/2005 | Niwa | 30/388 |

* cited by examiner

*Primary Examiner*—Stephen Choi
(74) *Attorney, Agent, or Firm*—Harry I. Leon

(57) ABSTRACT

A hand-held circular saw designed for making square cuts on workpieces. The saw is equipped with a pair of retractable guide pins located near the rear of the blade; when both pins touch the front edge of the workpiece the saw's blade is automatically perpendicular to it. The saw is also equipped with at least one torsion spring that temporarily holds the saw's blade above the workpiece. Without moving the saw's base, the user turns on the saw, and pressing downwardly on its handle, lowers the blade into the workpiece, making a square cut with the accuracy of a cut-off saw. The guide pins can also be automatically or manually retracted to convert the improved saw back to a conventional saw.

6 Claims, 5 Drawing Sheets

HAND-HELD CIRCULAR SAW WITH ALIGNMENT FEATURES FOR PERPENDICULAR CUTS

CROSS REFERENCE TO RELATED APPLICATION

This application is a non-provisional application of earlier filed provisional application Ser. No. 60/926,551 filed Apr. 27, 2007, and claims benefit of the priority date of the filing date Apr. 27, 2007, pursuant to U.S.C. sec.19(e).

BACKGROUND OF THE INVENTION

In construction projects it is desirable to have accurate square cuts on structural lumber. The hand-held circular saw is probably the most used tool for cutting in the field. Many devices, such as the carpenter's square, have been utilized in the past to improve the accuracy of square cuts made with hand-held circular saws. However, this approach requires the user to align two tools and consumes twice as much time per cut as it would to align a single tool. An improved hand-held circular saw which one can use by itself to make accurate square cuts is much needed.

SUMMARY OF THE INVENTION

The object of this invention is to provide an improved hand-held circular saw for making accurate square cuts quickly and safely.

A further object of this invention is to provide such an improved hand-held circular saw for making accurate bevel cuts on workpieces.

In a hand-held circular saw, the improvement comprises a pair of guide pins and a separate housing for each of them which is rigidly attached to a frame mounted on the saw's base. Extending downwardly from their respective housings, the guide pins, when fully extended, protrude a short distance below the base. Importantly, the longitudinal centerline of each guide pin lies in an imaginary plane disposed parallel to the axis of rotation of the saw's blade. In use, when the guide pins are extended, they rest against the front edge of the workpiece, thereby guiding the saw to cut perpendicularly to the front edge of the workpiece.

Prior to a user's initiating a cut with the improved saw, the saw blade is automatically held above the workpiece by a pair of torsion springs. Mounted proximate with the point where the saw's body is pivotally connected to its base, the torsion springs are biased in such a way as to hold the saw's body upwardly from the base. With the saw blade thus held temporarily out of contact with the workpiece, one can then easily rest the guide pins, in their extended mode, against the front edge of the workpiece and position the saw blade so that later on, when it is lowered, it makes an accurate cut. In order to actually lower the saw blade and penetrate the workpiece, the user, while holding the saw by its handle, needs only to exert sufficient pressure on the handle to overcome the bias of the torsion springs.

When the saw's body has been lowered so as to achieve the maximum depth of cut, a saw blade which is, for example, 7¼ inches in diameter will make a cut about 5½ inches wide and 2 inches deep. That is, the improved saw can be used to cut conventional 2×4 inch lumber without one's having to move the base of the saw, so that a 2×4 can be cut at a 90 degree angle as accurately as if one were using a cutoff or radial arm saw. Since the 90 degree cut on 2×4 inch lumber is used so many times on most construction projects, this feature alone can reduce time and bring about a higher quality of construction.

Similarly, the blade of the improved saw can be rotated at an angle of up to 45 degrees from the top surface of the workpiece; and the blade can then be lowered onto the workpiece for an accurate bevel cut.

Further, once the body of the improved saw has reached its lowest position relative to the workpiece, the guide pins are automatically retracted. This feature allows the user to guide the saw forward as though it were a standard hand-held circular saw. Moreover, after an initial cut of about 5½ inches has been made using a 7¼ inch diameter saw blade, by way of example, then the initial cut can serve as a good guide for the rest of a longer cut, if need be.

For wide cuts or wherever the required depth of the cut is less than full depth, a manual control lever is provided so that one can retract the guide pins. Once the guide pins are retracted, the saw then performs like a conventional saw. Further, for angle cuts the manual control lever can also be used to retract the guide pins. The user always has the option to use the special features of this saw or not as he so desires.

DETAILED DESCRIPTION OF THE PREFERRED EMBODIMENT

Figure 1:
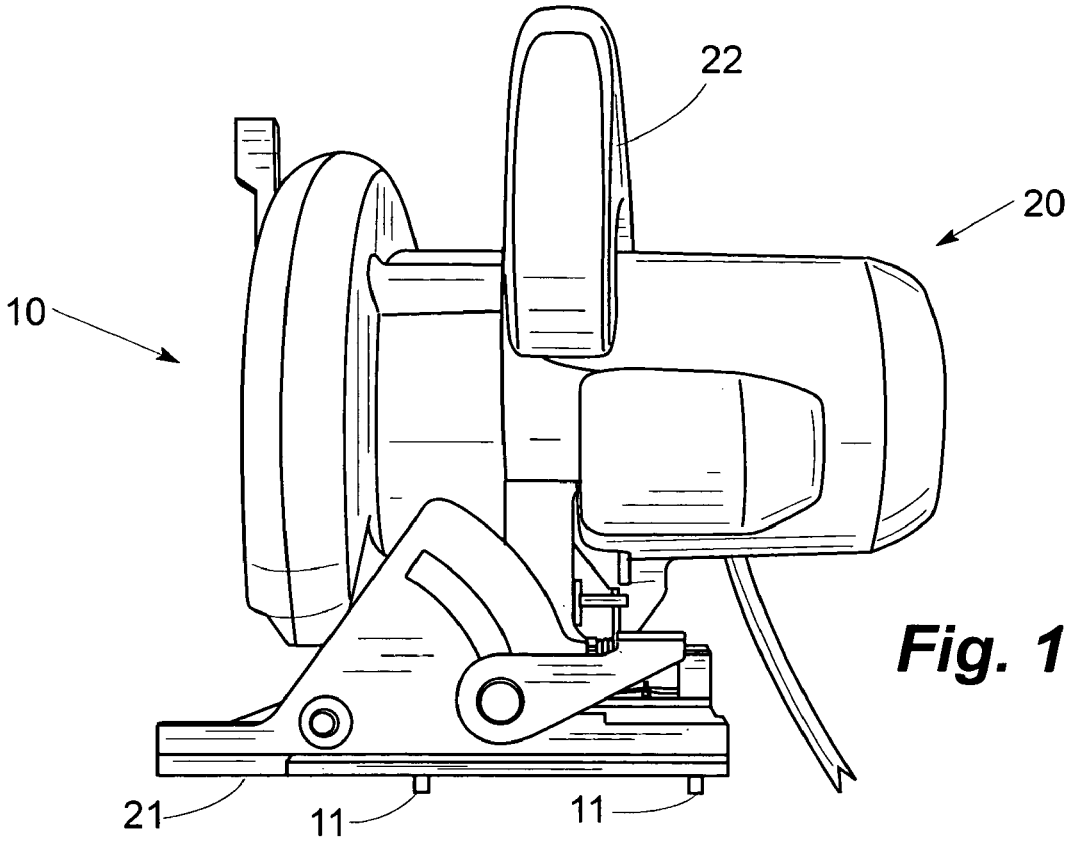
FIGS. 1 and 2 are front and rear views, respectively, of the improved saw according to the present invention, the saw being shown in its normal raised position prior to use.
Figure 2:
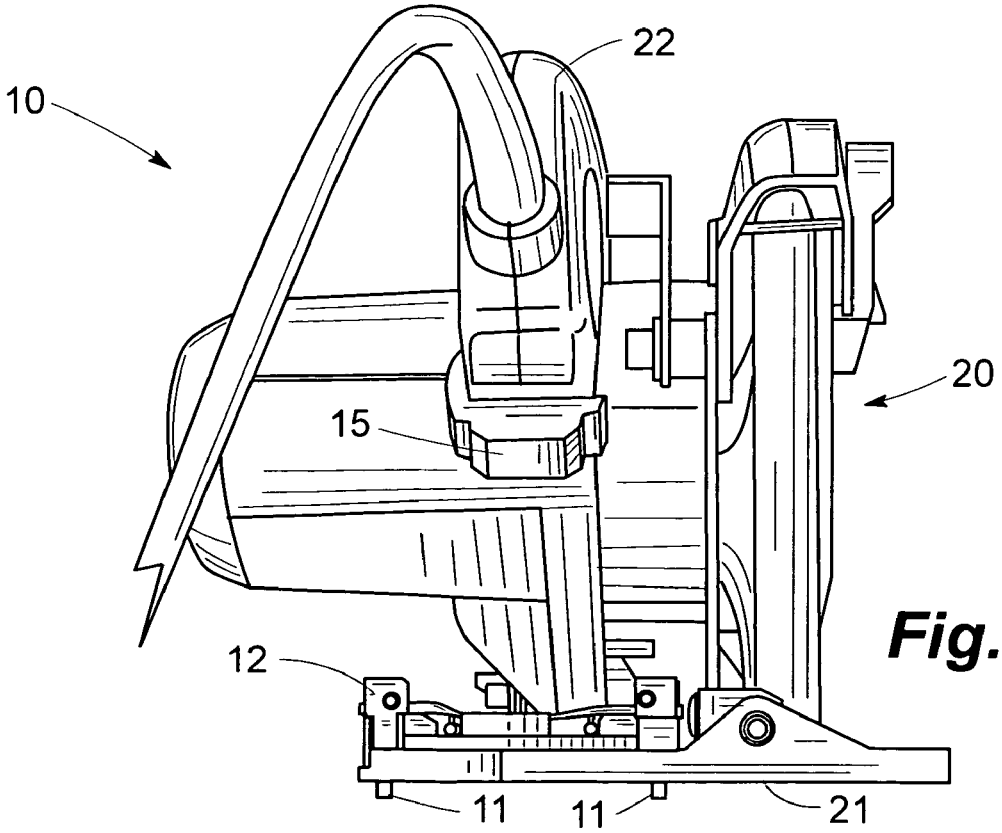

In the drawings, a hand-held circular saw 20 on which attachments in accordance with the present invention have been installed is given the reference numeral 10. Although the attachments can be adapted for use with many existing saws, it is preferable that the saws be manufactured in the factory so as to include these improvements.

Figure 3:
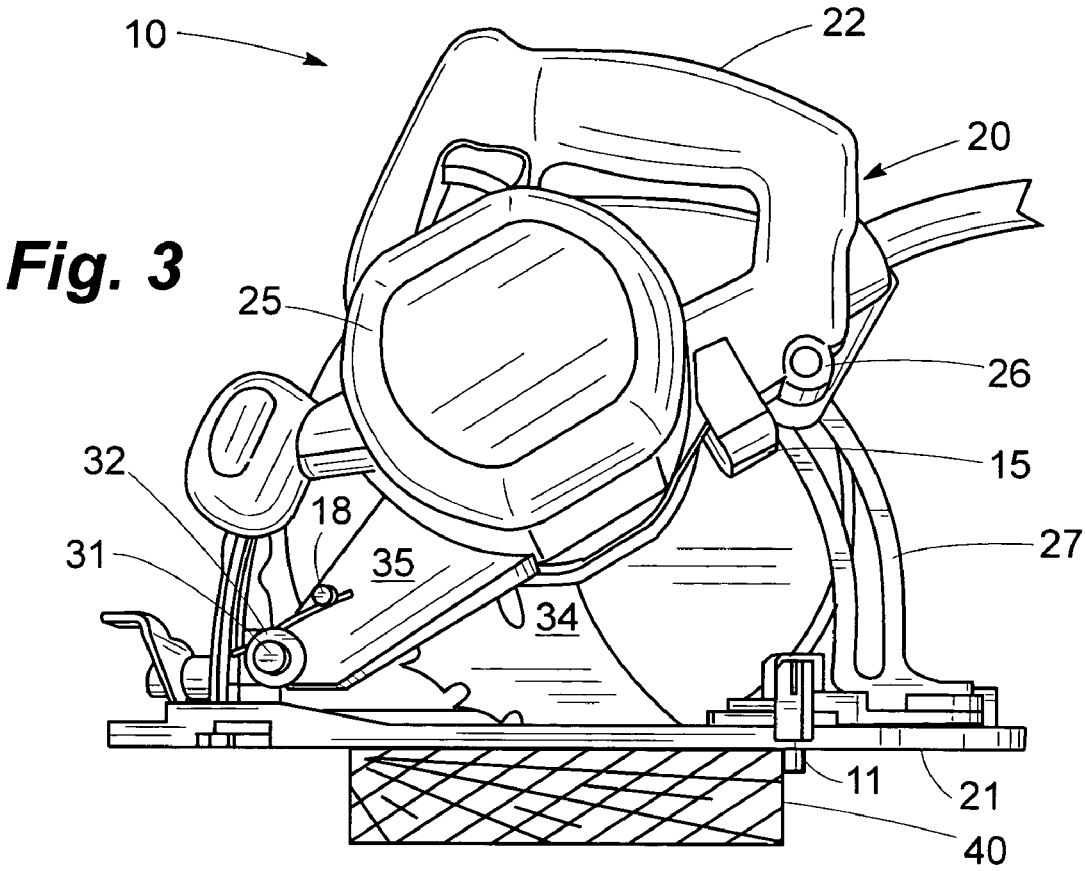
FIG. 3 is a side elevational view of the improved saw according to FIG. 1, the saw being shown in its normal raised position prior to use with the saw's base resting on a block of wood, the block of wood being shown for illustrative purposes only and forming no part of the invention.
Figure 4:
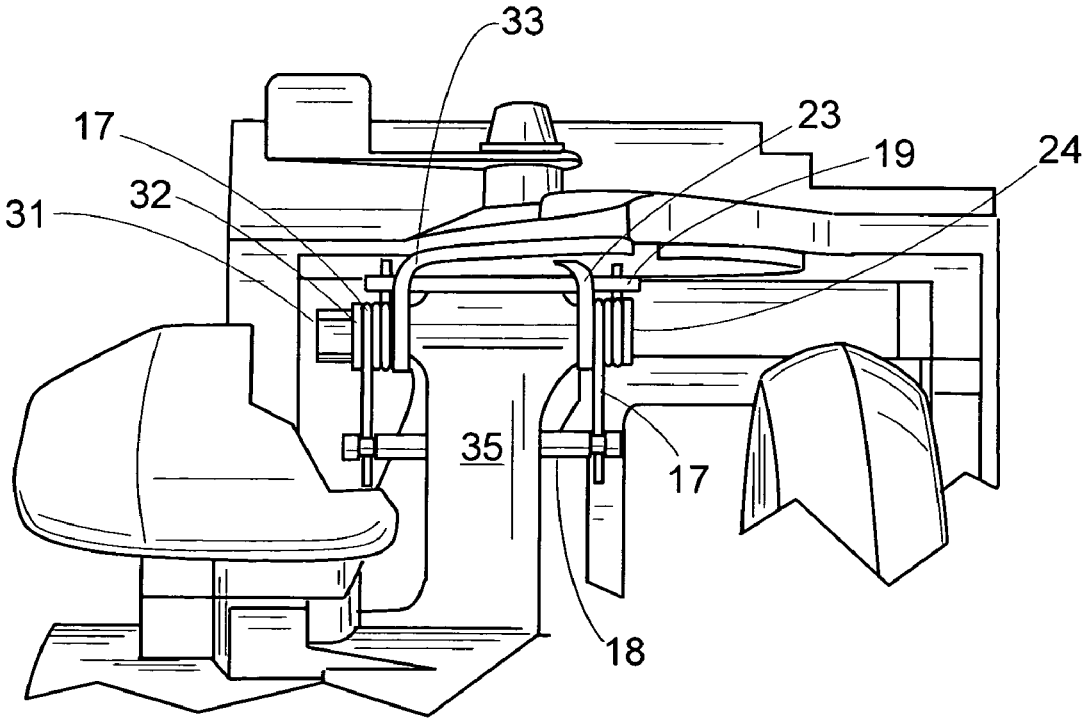
FIG. 4 is a plan view, on an enlarged scale, of a fragmentary portion of the front of the improved saw according to FIG. 1 and shows a pair of torsion springs mounted proximate with a bolt pivotally connecting the saw's body and base, the torsion springs being used to hold the saw above a workpiece prior to cutting it.
Figure 5:
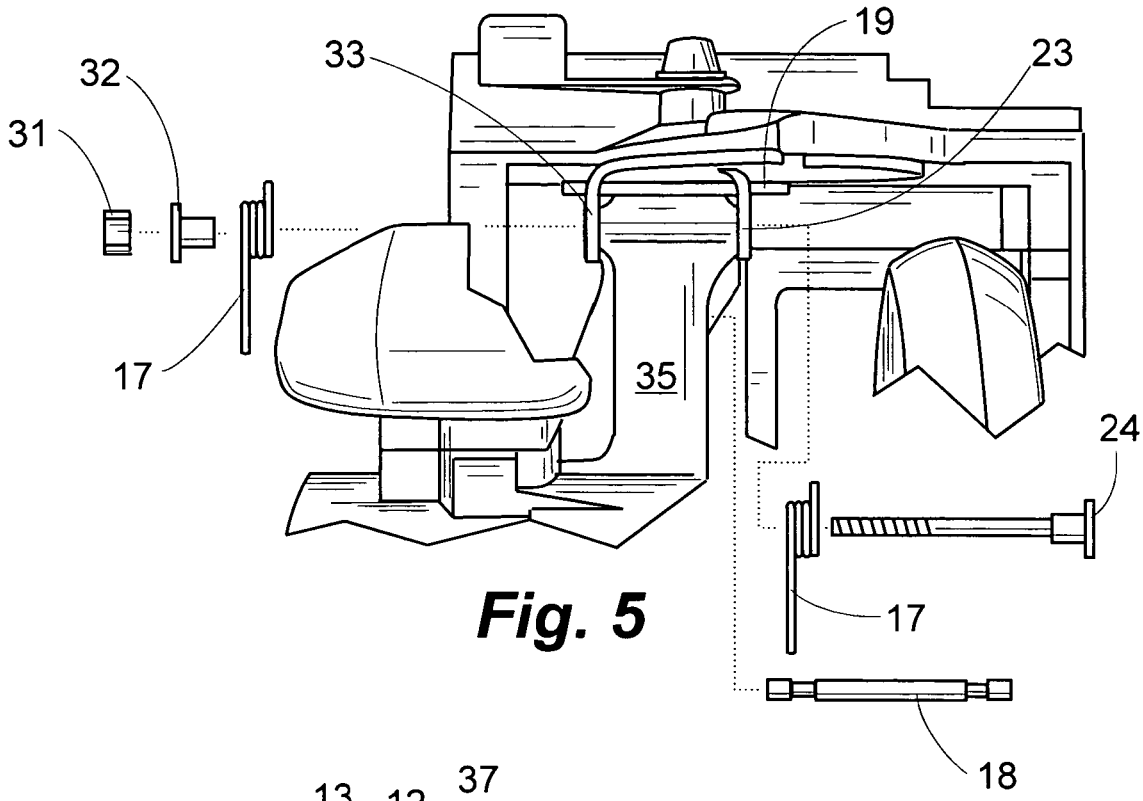
FIG. 5 is an exploded view of the fragmentary portion according to FIG. 4.
Figure 6A:
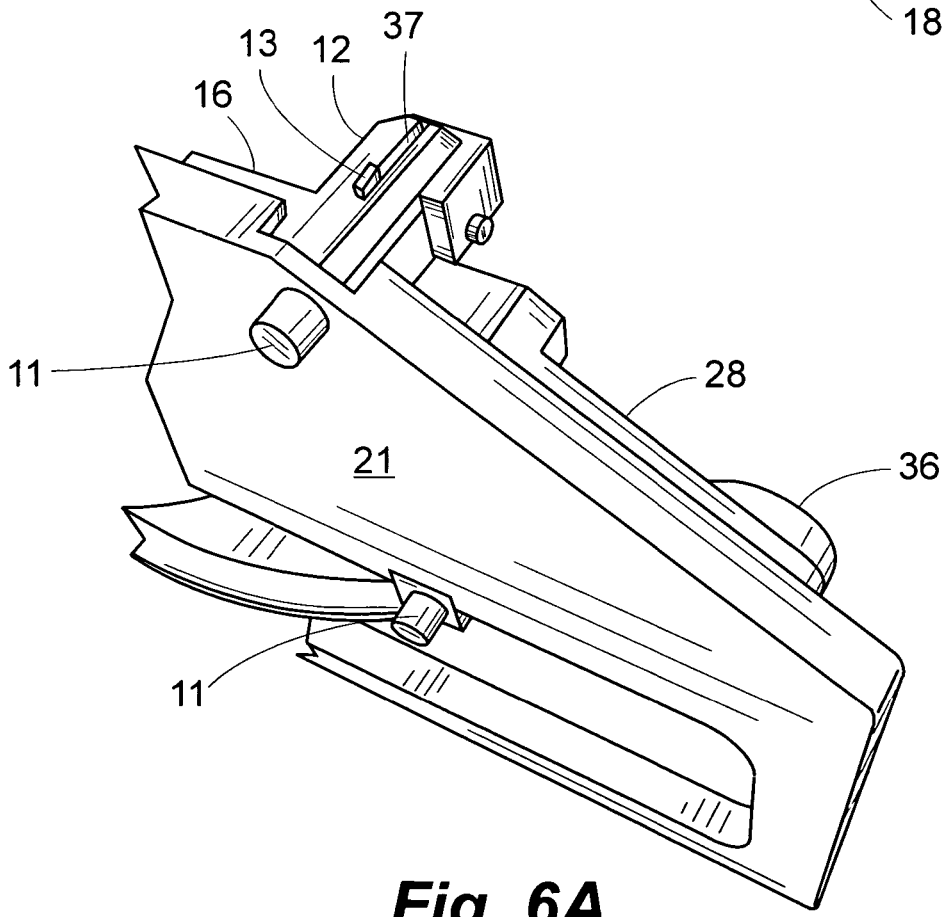
FIGS. 6A and 6B are perspective views, on a further enlarged scale, of a fragmentary portion of the rear of the improved saw according to FIG. 1 and show a pair of guide pins in their extended and retracted positions relative to the saw's base, respectively.
Figure 6B:
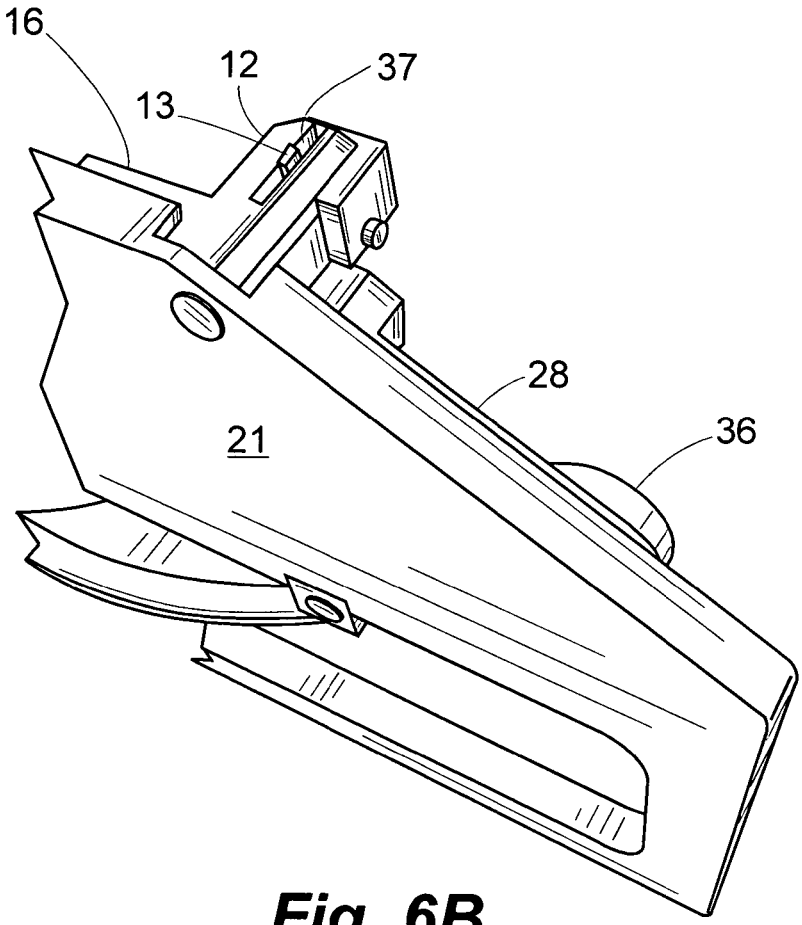

The improved saw 10 comprises a pair of spaced apart guide pins 11, a separate housing 12 for each of them, and a leaf spring 13 which interconnects the guide pins. A frame 16 rigidly attached to the saw's base 21 anchors the housings 12 within cutouts defined by the base. Slip fitted into their respective housings 12 and extendible downwardly therefrom, the guide pins 11 are mounted in such a way that their longitudinal centerlines lie in an imaginary plane disposed parallel to the axis of rotation of the saw's blade 34. When fully extended, the guide pins 11 protrude a short distance below the base 21 (FIGS. 1, 2, 6A, and 6B) Thus extended, the guide pins 11, with the saw's base 21 resting on the top surface of a workpiece 40 and with both guide pins abutting its straight front edge, can be used to guide the saw 20 to cut at a 90 degree angle to this edge (FIG. 3).

Figure 7A:
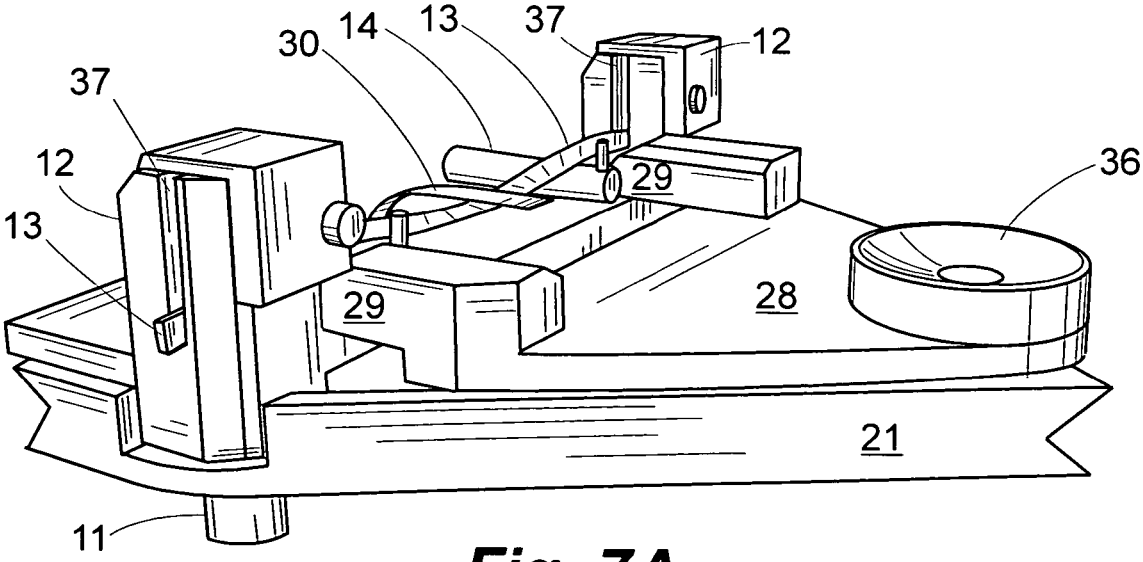
FIGS. 7A and 7B are perspective views of a fragmentary portion of the rear of the improved saw according to FIG. 1 showing a leaf spring coupled to the guide pins which is part of a guide pin activation mechanism, the pins being shown in their extended and retracted positions, respectively.

Near its top, each guide pin 11 defines a hole (not shown) sized to receive one end of the leaf spring 13 when it has been slip fitted into said hole. As is best illustrated in FIG. 7A, the leaf spring 13, biased by restraining spring 30, normally holds each guide pin 11 in its fully extended position. Otherwise, when the center of the leaf spring 13 is repositioned downwardly so as to overcome the bias of the restraining spring 30, the distal ends of the leaf spring, which overlie a pair of spaced apart fulcrums 14, move upwardly in slots 37, retracting the guide pins 11. So retracted, the saw 10 can be moved forward to cut the rest of the workpiece 40, if need be.

Figure 7B:
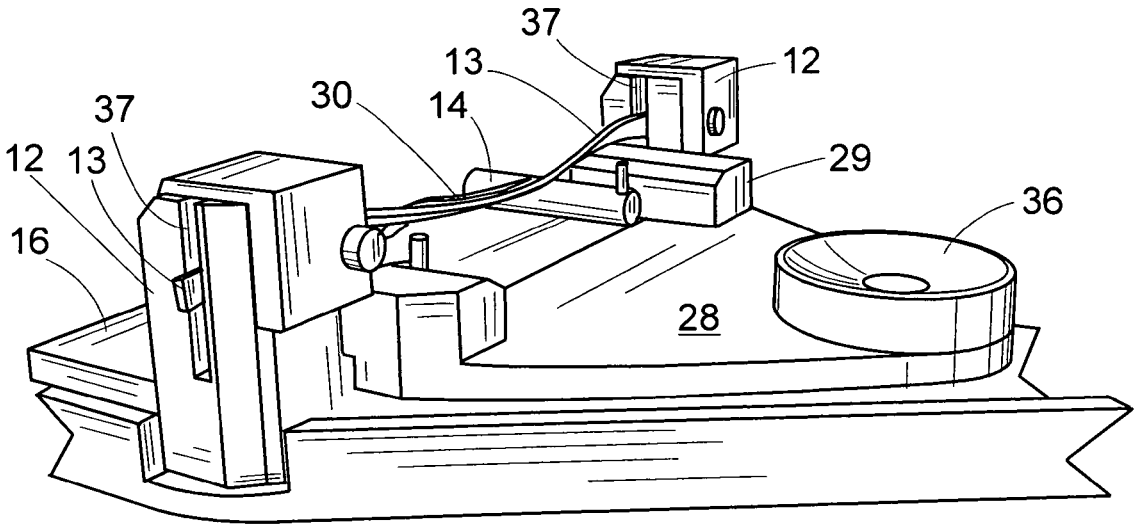

Repositioning the center of the leaf spring 13 so as to retract the guide pins 11 can be accomplished automatically or, alternately, manually. The pins 11 are retracted automatically by pressing downwardly on the saw's handle 22 until the saw's blade 34 penetrating the workpiece 40 has reached the blade's full depth. At this point, a cam 15 mounted on the underside of the handle 22 is pressed into the restraining spring 30, overcoming its biasing action on the leaf spring 13 and thereby retracting the guide pins 11 (FIGS. 3 and 7B).

Figure 8A:
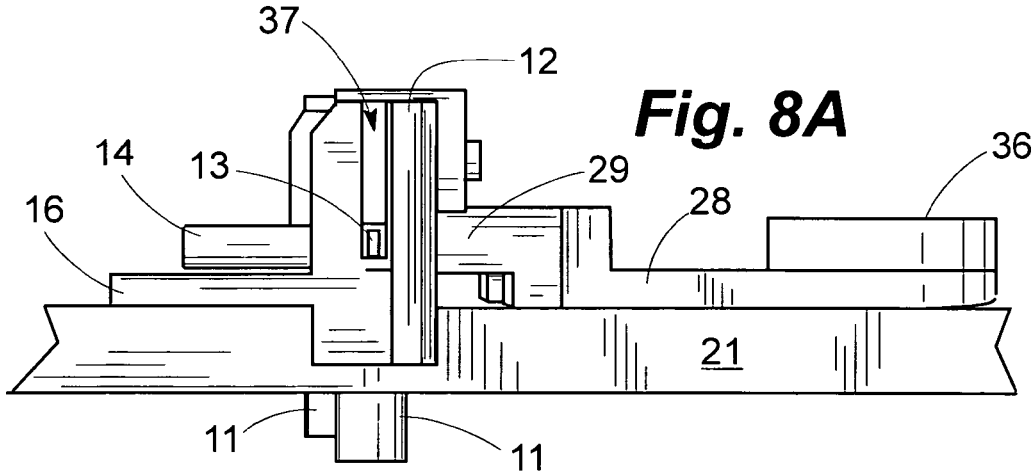
FIG. 8A is a side elevational view of a fragmentary portion of the rear of the improved saw according to FIG. 1 and shows the pins in their extended position as they are being acted upon by the leaf spring, a manual control lever with arms, otherwise slideably engageable with the leaf spring, being shown with said arms out of contact with the leaf spring.
Figure 8B:
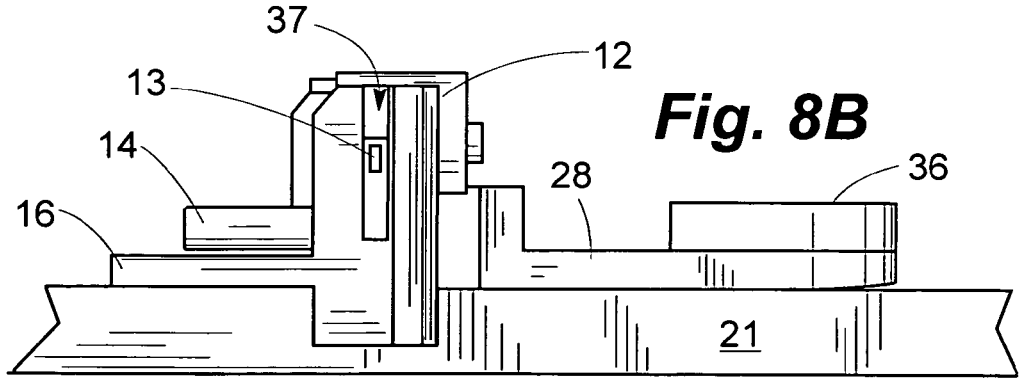
FIG. 8B is a side elevational view of a fragmentary portion according to FIG. 8A and shows the pins in their retracted position, after the arms of the manual control lever have been slid into contact with the leaf spring.

Manual retraction of the guide pins 11 is accomplished with the use of a retraction device 28. When the handle 36 of this retraction device is pushed forward, its tapered arms 29 slide under those portions of the leaf spring 13 which are disposed between the fulcrums 14 and the housings 12. This pushes on the distal ends of the leaf spring 13 which then move upwardly in slots 37, causing the guide pins 11 to retract (FIGS. 7B and 8B). When the guide pins are retracted, the saw 10 performs like a conventional hand-held circular saw.

As in conventional hand-held circular saws, the body 25, with its housing for the motor of the improved saw 10, is pivotally connected to its base 21 using a bolt 24 or equivalent. Unlike prior art saws, however, the saw 10 includes a pair of torsion springs 17 mounted on the bolt 24 and secured by a washer 32 and nut 31. Each torsion spring 17 is biased to hold the saw's body 25 upwardly relative to its base 21 so that the blade 34 is held above the workpiece 40. To keep tension on the torsion springs 17, their distal ends are held in place by grooves in a bar 18 which is mounted in structural element 35 and by protrusion 19 on bracket 33.

The saw's base is pivotally mounted on bracket 23. A bolt (not shown) pivotally holds brackets 23 and 33 together. When the connecting bolt is loosened, the base 21 is free to rotate up to 45 degrees for bevel cuts without being biased by the torsion springs 17. That is, the bias on the torsion springs 17 is not affected by the angle of the base 21 so the saw blade 34 can be held above the workpiece 40 regardless of whether the base 21 has been set for a flat or bevel cut.

In operation, the saw 10 is allowed to rise to its full height by loosening locking knob 26 on the depth control bar 27. For a square cut, the saw 10 is placed on the workpiece 40 at the desired location for the cut; and simultaneously the extended guide pins 11 are moved into position where they touch the front edge of the workpiece 40. The saw's motor is turned on and the user presses downwardly on the saw's handle 22 with sufficient force to overcome the bias upward force from torsion springs 17, thereby lowering the saw blade 34 onto the workpiece 40. The saw 10 with a 7¼ inch blade will cut through 2 by 4-inch and even 2 by 6-inch lumber with just the downward travel of the saw. When the saw's blade 34 reaches full depth, the cam 15 comes into contact with the spring 30, the spring 13 is bent over the fulcrums 14, and the guide pins 11 are automatically retracted. The saw is then free to advance further if required to cut a wider workpiece. An initial cut with a saw 10 having a 7¼ in diameter blade—cut which is perfectly perpendicular to the front edge of the work piece, serves as a guide for additional cutting. For narrower lumber such as typical 2×4 inch. studs, the cut will be quick and as accurate as if a cut-off saw was used.

This application discloses one embodiment of the invention. The guide pins 11 are shown on the drawings as having a cylindrical shape, but many other shapes would also be suitable. Further, there are other means for retracting the guide pins 11 such as hydraulic, pneumatic or electromagnetic. The limitation of this invention is only in the scope of the claims.

It is claimed:

1. An attachment for a hand-held circular saw, the attachment being adapted for making square cuts on a workpiece that has at least one straight front edge, comprising:

(a) at least two elongated pins which are slip fitted into holes located about a blade diameter from the front edge of the saw which when fully extended, protrude downwardly from the saw's base, the longitudinal centerline of each pin lying in an imaginary plane which is disposed parallel to the axis of rotation of the saw blade;

(b) means for temporarily holding the saw blade above the workpiece so that the saw's base, while resting on the workpiece, can be positioned in such a way that side walls of both pins simultaneously abut said front edge;

(c) means for lowering the saw blade by overcoming said means for temporarily holding it by pushing downwardly on the handle of the saw, so that the saw blade is brought into contact with the workpiece and the saw is further lowered to cut it; and (d) a means for automatically retracting the pins as the saw is lowered so that when the saw's blade is substantially at its full depth of cut, the pins are retracted and the saw can be moved forward if a wider cut in the workpiece is required.

2. The attachment according to claim 1, which further comprises a leaf spring which interconnects the pins, the pins being lowered below the base of the saw by spring action transmitted to the pins through the leaf spring.

3. The attachment according to claim 1, wherein the means for temporarily holding the saw blade above the workpiece comprises at least one torsion spring, the torsion spring being attached to the saw proximate with points thereon, where the saw's body including the motor housing, is pivotally connected to the base, the torsion spring biasing the saw's body upwardly from the base.

4. The attachment according to claim 1, which further comprises means for retracting the pins when a particular cutting operation requires a wider cut than would be possible with the pins extended.

5. An attachment for a hand-held circular saw, the attachment being adapted for making bevel cuts on a workpiece that has at least one straight front edge, comprising:

(a) at least two elongated pins which are slip fitted into holes that are about a blade diameter from the front edge of the saw, when fully extended protrude downwardly from the saw's base, the longitudinal centerline of each pin lying in an imaginary plane which is disposed parallel to the axis of rotation of the saw blade;

(b) means for orienting the saw's blade in such a manner that its axis of rotation is set at an fixed angle relative to the top surface of the workpiece;

(c) means for temporarily holding the saw blade above the workpiece so that the saw's base, while resting on the workpiece, can be positioned in such a way that the side walls of both pins simultaneously abut said front edge;

(d) means for lowering the saw blade by pushing downwardly on the handle of the saw overcoming said means for temporarily holding it, so that the saw blade is brought into contact with the workpiece and the saw is further lowered to make an accurate bevel cut; and (e) a means for automatically retracting the pins as the saw is lowered so that when the saw's blade is substantially at its full depth of cut the pins are retracted and the saw can be moved forward if a wider cut in the workpiece is required.

6. A mechanism for a handheld circular saw that gives the saw the performance and accuracy for a cut on a workpiece similar to that of a cut-off saw comprising:

a. at least two elongated pins which are slip fitted into holes that are about a blade diameter from the front edge of the saw, when the pins are fully extended they protrude downwardly from the saw's base; the longitudinal centerline of each pin lying in an imaginary plane which is disposed parallel to the axis of rotation of the saw blade;

b. at least one torsion spring that bias the saw so its blade is temporaly held above the workpiece;

c. at least one leaf spring that bias the pins on the top end of the pins to keep the distal end of the pins fully extended;

d. the pins are retracted when the saw is lowered by the user pushing downwardly on the saw's handle, cutting the workpiece and simultaneously a cam on the lower surface of the saw frame contacts the leaf spring and thereby retracts the pins, so that the saw could be pushed forward thereby giving a wider cut that would not have been possible with the pins extended.

* * * * *